United States Patent [19]

Tuomi

[11] Patent Number: 4,779,800

[45] Date of Patent: Oct. 25, 1988

[54] ABOVE-GROUND WATERING SYSTEM

[76] Inventor: James R. Tuomi, 19746 Weyher, Livonia, Mich. 48152

[21] Appl. No.: 917,695

[22] Filed: Oct. 10, 1986

[51] Int. Cl.[4] ..... B05B 15/06

[52] U.S. Cl. ..... 239/276; 239/547

[58] Field of Search ..... 249/85, 87; 239/200, 239/269, 271, 276, 542, 547

[56] References Cited

U.S. PATENT DOCUMENTS

| | | | |
|---|---|---|---|
| 648,263 | 4/1900 | Hull | 239/276 X |
| 3,227,408 | 1/1966 | Reed | 239/276 X |
| 3,387,786 | 6/1968 | Rynberk | 239/276 X |
| 3,588,012 | 6/1971 | Sohaefer | 248/80 |
| 3,603,511 | 9/1971 | La Pierre | 239/276 X |
| 3,998,392 | 12/1976 | St. Clair | 239/547 |
| 4,319,425 | 3/1982 | Shine | 239/276 X |

FOREIGN PATENT DOCUMENTS

| | | | |
|---|---|---|---|
| 362174 | 10/1922 | Fed. Rep. of Germany | 239/276 |
| 295946 | 7/1963 | Netherlands | 239/276 |

*Primary Examiner*—Andres Kashnikow
*Assistant Examiner*—Kevin Patrick Weldon
*Attorney, Agent, or Firm*—Rhodes and Boller

[57] ABSTRACT

An above-ground watering system for a lawn or garden plot is disclosed. The two ends of a length of flexible transparent PVC hose are connected to opposite ends of a poly fitting. The center tap of the poly fitting connects via a reducer to a garden hose connector. The transparent hose is perforated at intervals along its length, and stakes are used adjacent the perforations to hold the hose in place on the ground. When water is introduced from a standard garden hose which is connected to the hose connector, the water passes through the reducer and the fitting to enter the two ends of the transparent hose. Water exits the transparent hose via the perforations. The stakes comprises loops which securely grip the hose to hold the adjacent perforations in desired orientations to secure the desired spraying pattern of coverage for the plot.

9 Claims, 2 Drawing Sheets

ABOVE-GROUND WATERING SYSTEM

BACKGROUND AND SUMMARY OF THE INVENTION

This invention relates generally to watering systems for lawns and gardens. More specifically it relates to an above-ground watering system.

In-ground watering systems have enjoyed increased popularity in residential areas over recent years. Improved materials and controls have contributed to the commercial success of such systems. However, it is nonetheless necessary for the ground to be trenched in order for such systems to be installed, and while machinery is available to perform the trenching, the typical homeowner will not have access to such equipment and therefore may have to do the trenching by hand, or else incur the extra expense of having the system installed by a contractor.

Once an in-ground system is in place, the zone of coverage is defined; this is advantageous in that coverage of the defined area is assured, but i is disadvantageous because the zone of coverage cannot be changed without excavating and re-trenching. In climates where freezing temperatures are encountered, the system must be drained, and even at that it is subject to frost and freeze damage. Hence, in-ground systems have their pros and cons.

Above-ground garden hoses and water sprinklers are probably more common than in-ground systems. While they may be considered by some people to be less desirable than in-ground systems, they do in fact have certain advantages over in-ground systems. For one, an above-ground system can be moved from spot to spot, and it is not difficult to change the area of coverage. But, by the same token it may be difficult to consistently obtain spray patterns which provide the precise coverage of an in-ground installation, particularly when the hose and sprinkler have to be moved around. Such above-ground hoses and sprinklers can be easily drained and stored in winter. And they are considerably less expensive than in-ground systems.

One of the problems, however, with existing above-ground systems is that it is difficult to achieve uniform distribution at different points. For example, consider a perforated garden hose which has a series of perforations along its length. The ability of the hose to distribute water deteriorates as the more remote perforations are reached, and this condition is more pronounced where water pressures are low.

It is therefore desirable if a system could be developed which combines certain advantages of both in-ground and above-ground watering systems. That is one objective of the present invention.

A somewhat surprising consequence of the present invention is that the system is endowed with a superior pattern of distribution over an extended coverage area. The present invention achieves this significant improvement because of its configuration. Yet the hose can be conveniently adapted to plots of various shapes and sizes.

An ancillary aspect of the invention is that the system can be fabricated from conventional component parts. The superior performance of the hose is a result of the unique manner of configuring the parts in assembly.

Another ancillary aspect is that a system can, if desired, be sold in kit form for final assembly by the purchaser. It thereby becomes possible for the purchaser to adapt the hose to his or her particular requirements.

The foregoing features, advantages and benefits of the invention, along with additional ones, will be seen in the ensuing description and claims which should be considered in conjunction with the accompanying drawings. The drawings disclose a preferred embodiment of the invention in accordance with the best mode contemplated at the present time in carrying out the invention.

DESCRIPTION OF THE PREFERRED EMBODIMENT

Figure 1:
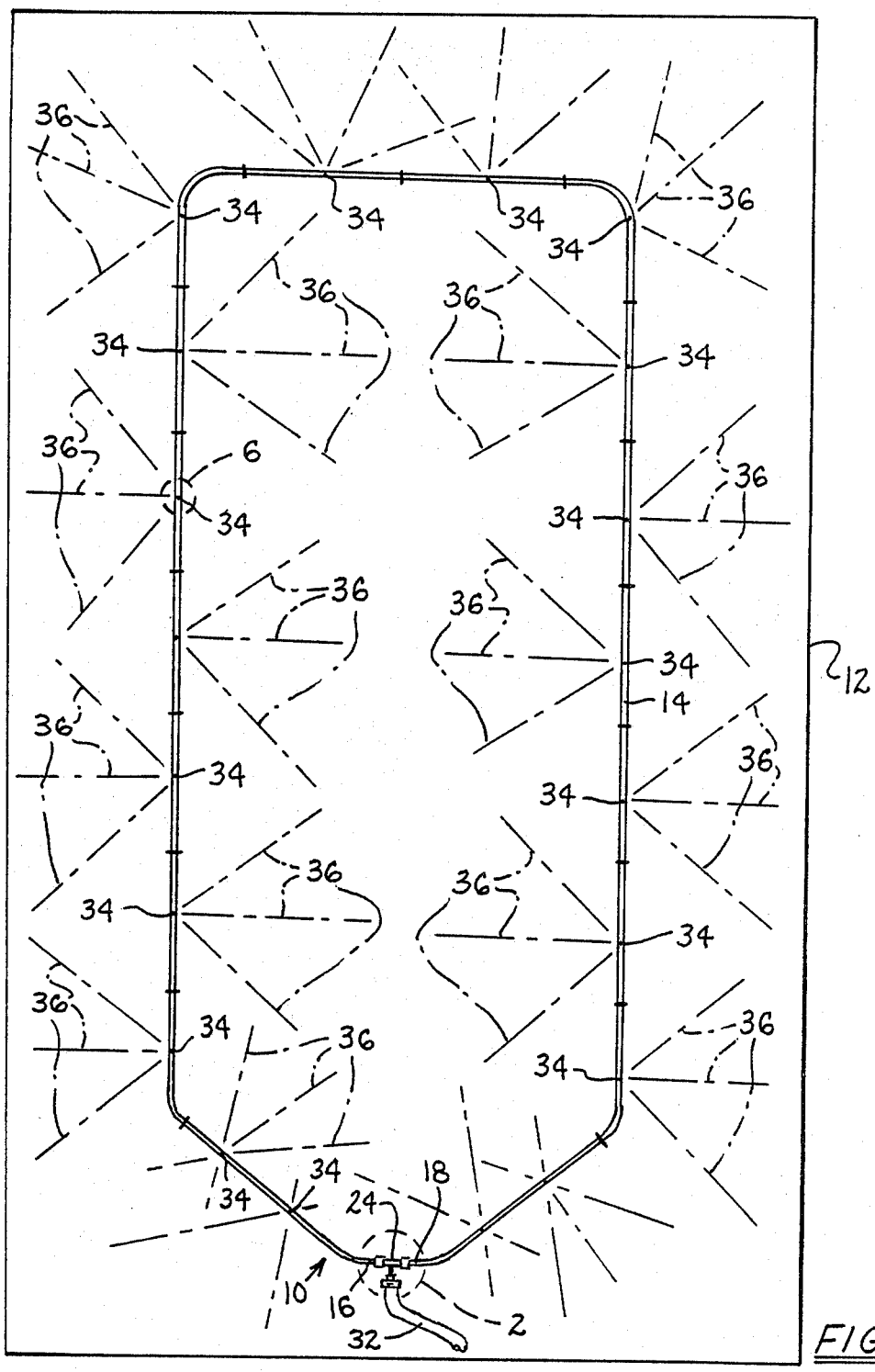
FIG. 1 is a schematic plan view of an example of a garden layout containing an above-ground watering system of the present invention.
Figure 2:
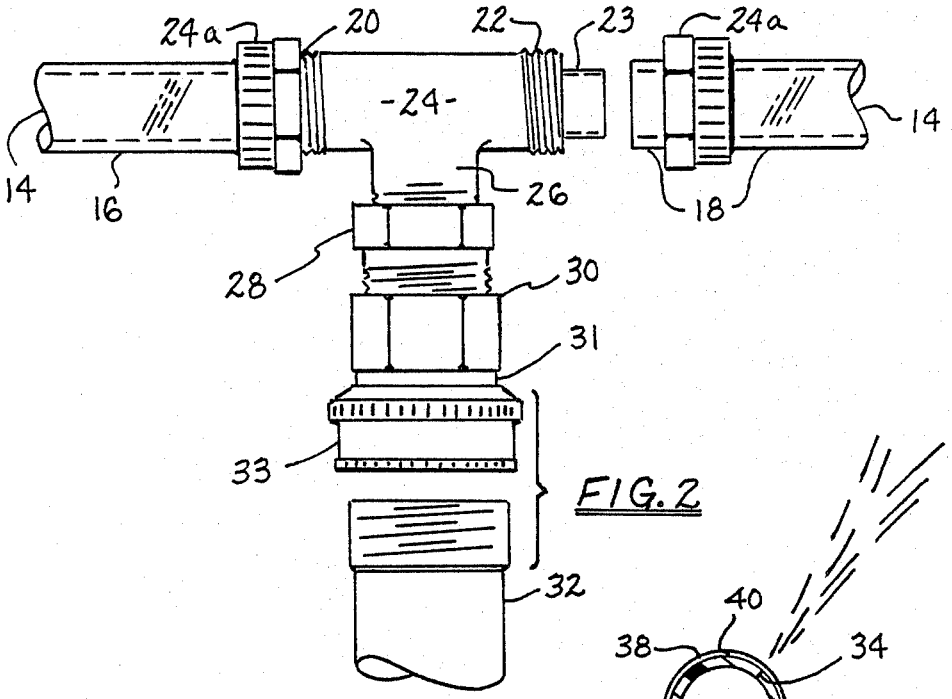
FIG. 2 is an enlarged view in circle 2 of FIG. 1, partly exploded.

FIG. 1 shows an example of an above-ground watering system 10 according to the present invention. System 10 is shown in use for watering a rectangular garden or lawn plot 12. The system comprises a length of hose 14, preferably clear PVC flexible non-toxic hose. The two ends 16, 18 of hose 14 connect in a leak-proof manner with two ends 20, 22 of a polypropylene fitting 24. Fitting 24 is commonly referred to as a poly fitting. It has a tap 26 between the two ends 20, 22. A preferred diameter for hose 14 is $\frac{3}{8}$ inch (ID), $\frac{1}{2}$ inch (OD), and therefore a conventional $\frac{3}{8}$ inch fitting 24 is used.

In order to adapt the fitting for connection to a water supply, a reducer $\frac{3}{8}$ inch$\times\frac{1}{2}$ inch is connected to tap 26. The reducer is designated by the reference numeral 28, with the smaller end of the reducer screwing onto tap 26.

A garden hose connector assembly 30 in turn screws onto the larger end of reducer 28. The preferred size of assembly 30 is $\frac{1}{2}$ inch$\times\frac{3}{4}$ inch. The connector assembly 30 comprises a body 31 having a female thread which screws onto the larger end of reducer 28. It also comprises a nut 33 which is axially captured on, but rotates about body 31. Nut 33 screws onto the threaded end of a garden hose 32 and contains a flat annular internal rubber washer thereby enabling the hose 32 to be connected to reducer 28 in a leak-proof manner.

The garden hose 32 has its other end connected to a water supply such as an outside faucet (not shown). When the faucet is opened, pressurized water flows through the hose 32, through reducer 28, and through fitting 24 to enter the two ends 16, 18 of the hose 14. From there, the water passes through hose 14 for ensuing distribution to water plot 12.

The poly fitting 24 has sleeves 23 onto which the ends 16, 18 of the hose 14 are inserted. Nuts **24*a* at the two ends of fitting 24** are subsequently tightened onto the hose's ends to thereby expeditiously attach and seal the hose ends to the fitting by compression so that leak-proof joints result. Pipe joint compound may be used at the reducer threads to seal the joints there.

The hose 14 distributes water through a series of small, substantially identical, slits at intervals along its length. These slits are designated by the reference numerals 34 and they may be on the order of 18–24 inches apart in a 100 foot length of hose 14, for example. Each slit is capable of producing a spray of 8 to 12 feet in height which can cover a significant area as schematically portrayed in FIG. 1. Surprisingly, the spray patterns 36 at the slits are quite uniform, and this is believed attributable, at least in part, to the fact that the two ends of the hose 14 are connected to the fitting 24 so that the hose does not dead-end. Rather the hose 14 forms an endless path for water which is teed into the path at fitting 24.

Figure 4:
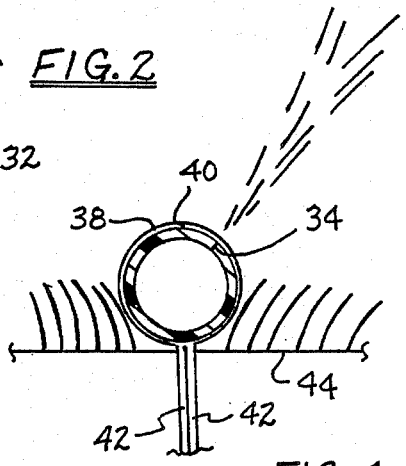
FIG. 4 is a fragmentary enlarged view of a portion of FIG. 3 to show more detail.
Figure 5:
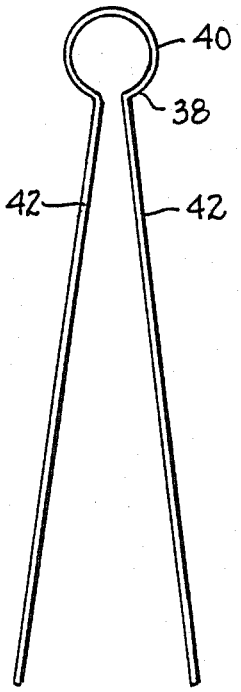
FIG. 5 is a view of one of the components of FIG. 3 shown by itself apart from the system.
Figure 3:
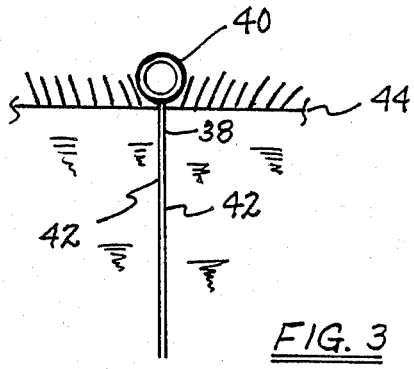
FIG. 3 is an enlarged sectional view taken in the direction of arrows 3—3 in FIG. 1.

The ability to direct and maintain an overall spray pattern is accomplished by the use of wire stakes 38. Preferably each stake is a sturdy wire which is coated with a material such as rubber or plastic. The stake comprises a central loop 40 from which extend a pair of legs 42. FIG. 5 shows the free condition of a stake. In this condition the hose 14 can be passed through the loop 40. When the legs 42 are urged together, the loop 40 securely grips the hose in the manner of FIGS. 3 and 4, and the substantially parallel legs 42 can be pushed into the ground 44 as shown in those two Figs.

Preferably each stake 38 is positioned in relation to an adjacent slit 34 to hold the slit in a desired direction of pointing (See FIG. 4, for example) to produce the desired coverage area for the particular slit. By doing this for each slit 34, total coverage of the plot is assured. Because the slits are small, their locations may not be readily visible before the hose is put to use or when the hose is not spraying. By applying a color indicator 45 to the hose at each slit (see FIG. 6), the slits+ locations are made much easier to find, and this can facilitate the initial installation or subsequent repositioning of the hose.

Figure 6:
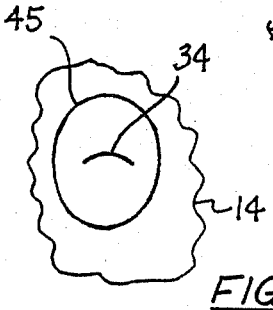
FIG. 6 is an enlarged view in circle 6 of FIG. 1.

Each slit is preferably made, not by removing material from the hose, but rather by slitting. A convenient way to create the slits is by means of a sharp pointed instrument. The slit 34 shown in FIG. 6 has been created by means of a pottery knife which has a sharp pointed curved tip. This tip is pushed into and through the hose wall to form the slit. While the exact size and location of each slit in a hose is not absolutely critical, the slits should be small in relation to the diameter of the hose. For example, in the hose 14 of $\frac{3}{8}$ inch (ID) by $\frac{1}{2}$ inch (OD), slits 34 which are on the order of $\frac{1}{8}$ inch at the outside of the hose wall, as represented at 48 in FIG. 6, are quite satisfactory in a 100 foot length of hose at the spacing distances previously specified.

A system embodying principles of the invention can be sold in kit form for final assembly by the purchaser. By providing a given length of hose in the kit for hose 14, the purchaser can use the full length or else cut the hose to any desired lesser length. Likewise, by providing the hose with no slits, the purchaser is enabled to impart any desired slit pattern. The ends of the hose can then be conveniently attached to the fitting 24 in the manner described above. Alternatively, a system embodying principles of the invention can be sold in a final assembled form ready for use.

While the intensity of the spray patterns will be a function of the pressure of water supplied from hose 32, and the size and pattern of the slits 34, the size reduction from hose 32 through reducer 28 to hose 14 also is believed to contribute to the intensity.

Therefore, the invention provides for attainment of desired full coverage of a lawn or garden plot by the combination of the hose configuration, the ability to twist the hose so that each slit points in a desired direction to produce the desired coverage, and the ability to stake the hose to the ground so that the aim of each spray pattern is maintained. Hence different shaped plots can be fully covered with the hose, and once a desired pattern of coverage has been attained at initial set-up, that pattern of coverage will remain the same until changed. But if change is desired, it can be conveniently performed.

The foregoing description of a preferred embodiment has disclosed and demonstrated the advantages of the invention. While a preferred embodiment has been disclosed and described, it is to be understood that principles of the invention are applicable to other embodiments within the scope of the following claims which defined the subject matter sought to be patented.

What I claim as my invention is:

1. An above-ground watering system for a lawn or garden plot comprising a length of flexible hose which has a circular transverse cross section and whose ends are connected to opposite ends of a fitting to form an endless closed path, a tap into the endless closed path at said fitting, and means for connecting said tap to a pressurized water supply, a series of apertures through the wall of said hose at locations along the hose's length, and a plurality of ground-engaging stakes disposed adjacent said apertures, each stake comprising a hose-engaging portion engaging said hose to allow the hose to be twisted over a continuous range of possible orientations about the hose axis and a ground-engaging portion engaging the ground for anchoring the hose to the ground, said stakes serving to allow the hose to be twisted for allowing the adjacent apertures to be aimed in desired directions and once the desired directions of aiming have been attained to securely hold the apertures in the desired directions of aiming to thereby produce a desired watering pattern for the plot, including a sleeve which is located at one of the opposite ends of said fitting and onto which the corresponding hose end is inserted, and a nut which is tightened to compress the corresponding hose end onto said sleeve at the one fitting end in a sealed manner, and in which a reducer is disposed at the tap into the fitting so that a hose of larger diameter than said first-mentioned hose can supply water to the fitting tap.

2. An above-ground watering system as set forth in claim 1 in which said stakes comprise wires each formed into a generally circular loop which constitutes the hose-engaging portion and substantially straight legs which project from ends of said loop and constitute the ground-engaging portion.

3. An above-ground watering system as set forth in claim 2 in which said wires are metal which is coated with a non-metallic covering.

4. An above-ground watering system as set forth in claim 1 in which said hose is transparent and including visible markers for indicating each aperture.

5. An above-ground watering system as set forth in claim 4 in which said apertures are in the form of slits.

6. An above-ground watering system as set forth in claim 1 in which said apertures are in the form of slits.

7. An above-ground watering system as set forth in claim 1 including a further sleeve which is located at the other of the opposite ends of the fitting and onto which the corresponding other end of the hose is inserted, and a nut which is tightened to compress the other corresponding hose end onto the further sleeve in a sealed manner.

8. An above-ground watering system for a lawn or garden plot comprising a length of flexible hose which has a circular cross-section and whose ends are connected to opposite ends of a fitting to form an endless closed path, a tap into the endless closed path at said fitting, and means for connecting said tap to a pressurized water supply, a series of apertures through the wall of said hose at locations along the hose's length, and a plurality of ground-engaging stakes disposed adjacent said apertures, each stake comprising a hose-engaging portion engaging said hose to allow the hose to be twisted over a continuous range of possible orientations about the hose axis and a ground-engaging portion engaging the ground for anchoring the hose to the ground, said stakes serving to allow the hose to be twisted for allowing the adjacent apertures to be aimed in desired directions and once the desired directions of aiming have been attained to securely hold the apertures in the desired directions of aiming to thereby produce a desired watering pattern for the plot, in which said hose is transparent and including visible markers for indicating each aperture, and in which said fitting comprises means forming a reducer such that a hose of larger diameter than said first mentioned hose can supply water to the fitting tap.

9. An above-ground watering system as set forth in claim 8 in which said apertures are in the form of slits.

* * * * *